US005133277A

United States Patent [19]

Peabody

[11] Patent Number: 5,133,277

[45] Date of Patent: Jul. 28, 1992

[54] ANCHORS

[76] Inventor: Andrew L. Peabody, P.O. Box 2120, Natchez, Miss. 39121

[21] Appl. No.: 642,902

[22] Filed: Jan. 3, 1991

[51] Int. Cl.[5] ..... B63B 21/32

[52] U.S. Cl. ..... 114/294; 114/301

[58] Field of Search ..... 114/294, 301, 302, 303, 114/304, 300; 52/155, 166

[56] References Cited

U.S. PATENT DOCUMENTS 3,961,451 6/1976 McCain ..... 114/301
4,397,256 8/1983 Bruce ..... 114/301 X

FOREIGN PATENT DOCUMENTS 2083428 3/1982 United Kingdom ..... 114/294

*Primary Examiner*—Sherman Basinger
*Attorney, Agent, or Firm*—Carroll F. Palmer

[57] ABSTRACT

An anchor having critically improved ability to penetrate and bury deep in mooring beds that can function well in a wide variety of mooring bed types is formed with a fluke component for burying into a mooring bed when it is cast on the bed and a shank component by which the anchor is attached to anchor rode. The fluke component is a contoured plate having identical starboard and port halves that increase in width from distal end to proximal end and meet in an apex at the center of the proximal end. The shank component has an elongated shaft bolted to a standard member above the plate with the shaft and the standard lying in a common plane with the longitudinal axis of symmetry of the plate. When the shaft is horizontal the plate is angled downward so its apex digs into the mooring bed when tension is applied to the anchor rode. Such angle may be varied to obtain maximum holding with different types of mooring beds.

8 Claims, 1 Drawing Sheet

H2
H1
VII
VIII
IX
X
10S
10P

ANCHORS

BACKGROUND OF THE INVENTION

1. Field of the Invention

This application relates to anchors for mooring vessels, platforms or other objects floating in a body of water over a mooring bed.

2. Description of the Prior Art

Anchors are very essential equipment for properly equipped marine vessels or the like that float in lakes, rivers and oceans. In many situations, the availability of suitable anchors can make the difference between survival or loss of a vessel or other object.

Mooring beds can vary markedly from one location to another, e.g., the bed may be sand, mud, rock, coral, grass, weed, etc. Some anchors hold well in one type of bottom, but fail to hold adequately in other types. For example, grass covered ocean or lake bottoms consistently present serious holding problems to many type anchors because of the tendency of the anchors to slide over such area rather than bury and hold. Hence, designers of anchors seek to make their anchors capable of providing suitable holding power with as many different type mooring beds as possible. Two popular type anchors are the so-called "Danforth" and "CQR" anchors. The former is a "stockless" anchor having a pair of flukes which pivot together upon the end of the shank. The latter is a "plow" anchor having a single, plow-shaped fluke pivoted to the end of the shank. Each of these anchor types exhibit different holding power with different type mooring beds, i.e., neither of them is a universal anchor for all type mooring beds.

Unless an anchor is used with a permanently moored object, e.g., a drilling rig, the ease with which an anchor can be stowed and the space required therefor is another critical factor in the designing of acceptable anchors. Thus, while large mushroom anchors are extensively used for permanent moorings, they are generally unsuitable for use as ground tackle aboard yachts, freighters and like marine vessels. To assist in the handling of anchors, a variety of special types of devices have been developed to aid in their stowage, e.g., see U.S. Pat. No. 4,248,171.

The problems of stowage and handling of anchors are influenced by the weight of the anchor relative to the holding power it will provide. Thus, if two different type anchors each exhibited substantially equal holding power statistics, the lighter of the two would be favored by most users, unless the cost of the lighter type is significantly higher than the heavier type. One recently developed anchor type, the so-called "Bruce" anchor, is alleged to exhibit high holding power per unit weight and to work well over a wide variety of mooring beds, e.g., see U.S. Pat. Nos. 3,777,695 and 4,397,256.

Another requirement of acceptable anchors is their ability to consistently assume an attitude when cast from a vessel onto the mooring bed that will ensure the anchor will penetrate and bury itself into such bed. Historically, in order to orient an anchor so that its fluke or equivalent burying portion would dig into the mooring bed, cross pieces, known as "stocks", were integrated into the anchors, e.g., as in the so-called "Navy" type anchors. As anchor designing has advanced, use of stocks have been eliminated as in the "Danforth" and "Bruce" type anchors or replaced by some other form of self-righting component, e.g., see U.S. Pat. No. 3,828,497. In any event, an acceptable anchor design must have the ability when cast onto a mooring bed to orient itself so that it will bury rather than slide over the bed surface.

The present invention offers a new anchor design that successfully addresses the various requirements of acceptable anchors as discussed above.

OBJECTS

A principal object of the invention is the provision of anchors of improved design that have very high holding power relative to their size and weight in comparison to other known type anchors.

Further objects are the provision of:

1. A unique anchor design having critically improved ability to penetrate and bury deep in mooring beds.
2. Such anchors that can function well in a wide variety of mooring beds.
3. Anchors that are self-righting when cast upon a mooring bed without requiring inclusion of a stock as a part thereof.
4. Such anchors that dig continuously and deeply into a mooring bed when a strain is placed thereon by the anchor rode.
5. An anchor that will not twist out or rotate out of the mooring bed when a strain is placed upon it, e.g., an anchor which is stable under strain.
6. An anchor that has an adjustable angle of penetration into a mooring bed.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of an anchor comprising a fluke component for burying into a mooring bed when the anchor is cast on the bed from a vessel or other object seeking to moor above the bed and a shank component by which the anchor is attached to anchor rode dispensed from the vessel.

The fluke component consists of a contoured plate having a longitudinal axis of symmetry that divides it into substantially identical starboard and port halves. It is defined by a proximal end, a distal end, a pair of similar sides, a top surface and a bottom surface, all integral therewith. Such proximal end is a contoured line and the distal end is an arcuate line, shorter in length than the contoured line, that extends at an obtuse angle relative to each of the sides.

The contoured line as it progresses inwardly from the sides first has starboard and port straight portions that extend approximately normal respectively to the starboard and port sides and then starboard and port arcuate portions which meet at the aforesaid longitudinal axis forming a central apex is proximal of at least parts of the arcuate portions.

The halves increase in width from their distal end to their proximal end and their top surfaces arch upwardly from the longitudinal axis so that the starboard and port straight portions of the contoured line constitute the outboard extremities of the fluke component.

The shank component comprises (a) an elongated shaft having a proximal end and a distal end and (b) a standard member, preferably shorter in length than the shaft.

The standard member has an "L" shape including an upper end, a leg portion and a foot portion. The upper end contains a plurality of transverse bores though which bolts extend to join the distal end of the shaft to the standard member. The foot portion is joined to the top surface of the plate with the shaft, the standard member and the longitudinal axis of symmetry all lying in a common plane. The junction of the foot portion of the standard member with the top surface of the plate is at the distal end of the top surface and arranged so the longitudinal axis of the leg portion makes an acute angle with the longitudinal axis of symmetry and with the proximal end of the shaft positioned proximal of the point.

The shaft has a yoke at its distal end that snugly receives the upper end of the standard member and the yoke contains transverse bore to receive bolts passed through bores in the upper end of the standard member. Also, the shaft has a transverse bore or other means adjacent its proximal end for attaching anchor rode to the anchor.

In preferred embodiments of the anchor, the plate has substantially uniform thickness throughout and its proximal end (the contoured line) is between about 3.2 to 3.5 times as long as the distal end (the arcuate line). Also, the lengths of each of the straight portions of the contoured line are between about 0.03 to 0.05 times the length of the entire contoured line. Further, the length of such similar sides and the height of the proximal ends of the similar sides above the central point in the proximal end of the plate is between about 0.4 and 0.6 the height of the middle of the upper end of the standard member above such point.

Preferably, the transverse bores in the upper end of the standard member are positioned so that the acute angle the longitudinal axis of the shaft makes with the longitudinal axis of symmetry is between about 20 and 50 degrees, especially 33 degrees for the standard anchor and 45 degrees for the deep draw anchor.

BRIEF DESCRIPTION OF THE DRAWINGS

A more complete understanding of the invention can be obtained by reference to the accompanying drawings in which.

DESCRIPTION OF PREFERRED EMBODIMENTS

Figures 1, 2, 3, 4, 5, 6, 7, 8, 9, 10, 11, 12, 13:
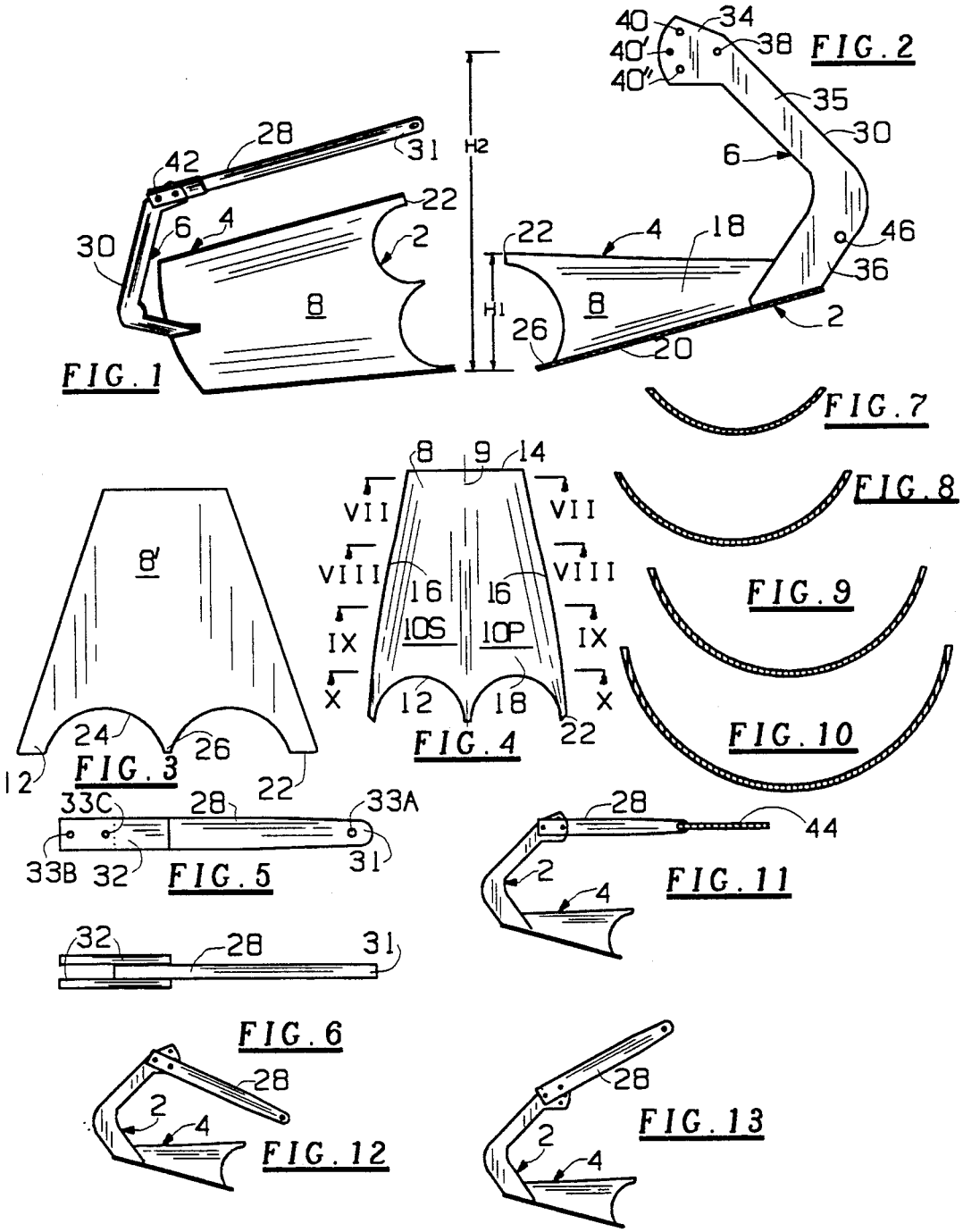
FIG. 1 is a perspective view of an anchor of the invention.
FIG. 2 is a lateral sectional view of the anchor of FIG. 1.
FIG. 3 is plan view of a metal plate cut to form the fluke component of the anchor of FIG. 1 prior to being bent into shape to form the fluke component.
FIG. 4 is plan view of fluke component of the anchor of FIG. 1.
FIG. 5 is a lateral view of the shaft of the anchor of FIG. 1.
FIG. 6 is a plan view of the shaft.
FIG. 7 is a sectional view taken on the line VII—VII of FIG. 4.
FIG. 8 is a sectional view taken on the line VIII—VIII of FIG. 4.
FIG. 9 is a sectional view taken on the line IX—IX of FIG. 4.
FIG. 10 is a sectional view taken on the line X—X of FIG. 4.
FIG. 11 is a lateral view of the anchor of FIG. 1 with the shaft in one of its three adjustable positions.
FIG. 12 is a lateral view of the anchor of FIG. 1 with the shaft in a second of its three adjustable positions.
FIG. 13 is a lateral view of the anchor of FIG. 1 with the shaft in another of its three adjustable positions.

Referring in detail to the drawings, the anchor 2 of the invention comprises a fluke component 4 and a shank component 6.

Fluke component 4 consists of a contoured plate 8 having a longitudinal axis of symmetry 9 that divides it into substantially identical starboard and port halves 10S and 10P respectively. It is defined by a proximal end 12, a distal end 14, a pair of similar sides 16, a top surface 18 and a bottom surface 20.

Proximal end 12 is a contoured line having starboard and port straight portions 22 that extend approximately normal respectively to the starboard and port sides 16 and starboard and port arcuate portions 24 which meet to form a point 26.

The fluke component 4 is made by cutting a metal plate into an outline 8' (FIG. 3) which is then bent into the shape shown in FIG. 4 with contours as shown in FIGS. 7–10.

The shank component 6 includes an elongated shaft 28 and a standard member 30. Shaft 28 has a proximal end 31 with transverse bore 33A and a distal end in the form of a yoke 32 provided with distal transverse bore 33B and proximal transverse bore 33C.

The standard member 30 includes an upper end 34, a leg portion 35 and a foot portion 36 that is joined, such as by welding, to the top surface 18 of the plate 8. The upper end 34 contains a transverse distal bore 38 and three transverse proximal bores 40, 40' and 40'' through which bolts 42 extend to join the yoke 32 of shaft 28 to the standard member 30. As can be seen in FIGS. 11–13, the shaft can be moved into three different positions relative to the fluke component 4. Advantageously, the bores 40–40'' are positioned relative to the bore 38 so that when the shaft 28 is bolted through bore 40' (FIG. 11), the shaft extends at an angle of about 33° relative to the longitudinal axis 9, when bolted through bore 40'' (FIG. 12) at an angle of about 22° and when bolted through bore 40 (FIG. 13) at an angle of about 45°.

In the specific anchor shown in the drawings, the proximal end 12 is 3.5 times as long as the distal end 14, the straight portions 22 are 0.6 the length of the full proximal end 12 and each side 16 has a slight upward bend therein about 0.6 the length thereof from the distal end 14. Also, the shaft 28 is 1.2 the length of sides 16. The height H1 of the proximal ends 22 of the sides 16 above the point 26 is 0.45 to 0.55 the height H2 between point 26 and the horizontal plane of the bores 38 and 40'.

It will be apparent that bore 33 is used to shackle anchor rode 44 to the shaft 28 and that the bore 46 may be used to fasten a lanyard (not shown) to assist in retrieval of the anchor 2. Such rode can be chain, rope, wire cable or any combination thereof and the term "anchor rode" as used herein should be so construed.

In April of 1990, tests were performed on ten different anchors in the mud bottom of San Francisco Bay, Calif., off Candlestick Park to evaluate the relative holding powers of the anchors in the mud bottom considered to be soft. The anchors included one of the present invention, i.e., Creative Marine MAX, and others manufactured by Rule-Danforth, Nav-X, Simpson-Lawrence, CQR and Bruce. The results of these tests are reported in the following table which lists the weight of each anchor, the average holding power in pounds of pull and the number of pulls that were averaged.

| Anchor | Weight | Aver. H. Power | # Pulls |
|---|---|---|---|
| MAX (Creative Marine) | 38 | 800 | 2 |
| T-4000 (new) (Danforth) | 30 | 675 | 2 |
| Fortress 37 (Nav-X) | 20 | 579 | 6 |
| H-1800 (Danforth) | 33 | 514 | 6 |
| T-4000 (old) (Danforth) | 30 | 488 | 6 |
| P-1800 plow (Danforth) | 45 | 425 | 2 |
| CQR plow | 47 | 358 | 6 |
| Bruce | 46 | 247 | 6 |
| Delta (Simpson-Lawrence) | 33 | 222 | 6 |

The embodiments of the invention in which an exclusive property or privilege is claimed are defined as follows:

1. An anchor comprising:

a fluke component for burying into a mooring bed when said anchor is cast on said bed from a vessel seeking to moor above said bed, and a shank component by which said anchor may be attached to an anchor rode dispensed from said vessel, said fluke component consisting of a contoured plate having identical starboard and port halves divided by a longitudinal axis of symmetry, said plate being defined by a proximal end, a distal end, a pair of similar starboard and port sides, a top surface and a bottom surface, all integral therewith, said proximal end being a contoured line and said distal end being an arcuate line, shorter in length than said contoured line, that lies in a plane normal to said longitudinal axis, said contoured line as it progresses inwardly from said starboard and port sides first having starboard and port straight portions that extend approximately normal respectively to said starboard and port sides and then starboard and port arcuate portions which meet at said longitudinal axis forming a apex, said halves increasing in width from said distal end to said proximal end and having their top surfaces arched upwardly from said longitudinal axis so that said starboard and port straight portions of said contoured line constitute the outboard extremities of said fluke component, and said shank component comprising an elongated shaft having a proximal end and a distal end that includes a yoke and a standard member of L-shape having an upper end, a leg portion and a foot portion, said yoke of said shaft being pivoted to said upper end, said foot portion being joined to said top surface of said plate with said shaft, said standard member and said longitudinal axis of symmetry all lying in a common plane.

2. The anchor of claim 1 wherein said plate has substantially uniform thickness throughout.

3. The anchor of claim 1 wherein said shank has a transverse bore for attaching said anchor rode to said anchor.

4. The anchor of claim 1 wherein said contoured line of said proximal end is between about 3.2 to 3.5 times as long as said arcuate line of said distal end.

5. The anchor of claim 1 wherein the length of said straight portions of said contoured line are between 0.03 to 0.05 times as long as said contoured line.

6. The anchor of claim 1 wherein the length of said shaft is between about 1.0 and 1.3 the length of said similar sides.

7. The anchor of claim 1 wherein the height H1 of said proximal ends of said starboard and port sides of said plate above said apex is between about 0.45 and 0.55 the height H2 from said apex to the horizontal plane of where said yoke of said shaft is pivoted to said upper end of said standard member.

8. An anchor comprising:

a fluke component for burying into a mooring bed when said anchor is cast on said bed from a vessel seeking to moor above said bed having a proximal end and a distal end, and a shank component by which said anchor may be attached to an anchor rode dispensed from said vessel, said fluke component consisting of a contoured plate having a longitudinal axis of symmetry that divides it into substantially identical starboard and port halves, said shank component comprising an elongated shaft having a proximal end and a distal end that includes a yoke and a standard member of L-shape including an upper end, said yoke having a proximal transverse bore and a distal transverse bore therein, and said standard member upper end having a single distal transverse bore and a plurality of proximal transverse bores therein, said yoke being pivoted to said upper end by a bolt that extends through said yoke distal transverse bore and said upper end distal transverse bore permitting said shaft to be positioned at different angles relative to said longitudinal axis by a pin extending through one of said upper end proximal transverse bores and said yoke proximal transverse bore.

* * * * *